US008559864B2

(12) United States Patent
Yano

(10) Patent No.: US 8,559,864 B2
(45) Date of Patent: Oct. 15, 2013

(54) MEDIUM CONVEYING DEVICE AND IMAGE FORMING APPARATUS WHICH HAS AN INCLINED ROLLER THAT MAINTAINS LINE CONTACT

(75) Inventor: Kenichirou Yano, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 711 days.

(21) Appl. No.: 12/536,091

(22) Filed: Aug. 5, 2009

(65) Prior Publication Data

US 2010/0219225 A1 Sep. 2, 2010

(30) Foreign Application Priority Data

Feb. 27, 2009 (JP) ..... P2009-045007

(51) Int. Cl.
*G03G 15/00* (2006.01)

(52) U.S. Cl.
USPC ..... 399/384; 399/395

(58) Field of Classification Search
CPC ..... G03G 15/6517; G03G 15/652; G03G 2215/00561; B41J 15/046; B65H 23/02; B65H 23/038
USPC ..... 399/384, 395; 271/251; 226/168; 242/615.2; 400/579, 633
See application file for complete search history.

(56) References Cited

U.S. PATENT DOCUMENTS

| | | | | |
|---|---|---|---|---|
| 4,919,318 | A * | 4/1990 | Wong | 226/17 |
| 7,537,211 | B2 * | 5/2009 | Furihata et al. | 271/251 |
| 2004/0175213 | A1 * | 9/2004 | Matsuzuki et al. | 399/384 |
| 2004/0223795 | A1 * | 11/2004 | Ono et al. | 399/329 |

FOREIGN PATENT DOCUMENTS

| | | | |
|---|---|---|---|
| JP | 58109344 | * | 6/1983 |
| JP | 2006-248732 | | 9/2006 |
| JP | 2007-070089 | A | 3/2007 |
| JP | 2007-279257 | | 10/2007 |

OTHER PUBLICATIONS

Office Action dated Feb. 25, 2013 issued by the Japanese Patent Office in counterpart Japanese Application No. 2009-045007.

* cited by examiner

*Primary Examiner* — Judy Nguyen
*Assistant Examiner* — Blake A Tankersley
(74) *Attorney, Agent, or Firm* — Sughrue Mion, PLLC

(57) ABSTRACT

A medium conveying device includes: an inclined roller that feeds a recording medium in a direction that is inclined from a conveying direction of the recording medium; and a counter member disposed at such a position as to be opposed to the inclined roller with the recording medium interposed in between and having a curved surface on a side of the inclined roller, and one of an outer circumferential surface of the inclined roller, a rotation axis of the inclined roller, and the curved surface of the counter member is inclined according to an angle between a feed direction of the inclined roller and the medium conveying direction and a radius of curvature of the curved surface so that the outer circumferential surface of the inclined roller and the curved surface of the counter member contact each other approximately in line contact.

7 Claims, 7 Drawing Sheets

MEDIUM CONVEYING DEVICE AND IMAGE FORMING APPARATUS WHICH HAS AN INCLINED ROLLER THAT MAINTAINS LINE CONTACT

CROSS-REFERENCE TO RELATED APPLICATIONS

This application is based on and claims priority under 35 USC 119 from Japanese Patent Application No. 2009-045007 filed on Feb. 27, 2009.

BACKGROUND

1. Technical Field

The present invention relates to a medium conveying device and an image forming apparatus.

2. Related Art

Among image forming apparatus are ones in which images are formed on a continuous sheet (hereinafter also referred to as "pinless continuous sheet") which extends in one direction and does not have feed holes. In image forming apparatus in which images are formed on a pinless continuous sheet, usually, in a process of conveying a pinless continuous sheet, the pinless continuous sheet is positioned by feeding it obliquely with an inclined roller and thereby bringing one edge of the sheet into sliding contact with a guide member.

SUMMARY

According to an aspect of the invention, there is provided a medium conveying device having an inclined roller for feeding a recording medium in a direction that is inclined from a conveying direction of the recording medium, and a counter member disposed at such a position as to be opposed to the inclined roller with the recording medium interposed in between and having a curved surface on the side of the inclined roller, characterized in that one of an outer circumferential surface of the inclined roller, a rotation axis of the inclined roller, and the curved surface of the counter member is inclined according to an angle between a feed direction of the inclined roller and the medium conveying direction and a radius of curvature of the curved surface so that the outer circumferential surface of the inclined roller and the curved surface of the counter member contact each other approximately in line contact.

BRIEF DESCRIPTION OF THE DRAWINGS

Exemplary embodiments of the present invention will be described in detail based on the following figures, wherein.

DESCRIPTION OF SYMBOLS

1 . . . Conveying path; 2 . . . Image forming unit; 3 . . . Fuser; 4 . . . Drive roller unit; 5 . . . Skew sensor; 6 . . . Conveyance control unit; 10 . . . Back tension mechanism; 20 . . . Back feed mechanism; 30 . . . Aligning mechanism; 31 . . . Inclined roller; 32 . . . Counter member; 33 . . . Side guide; 34 . . . Switching mechanism.

DETAILED DESCRIPTION

A medium conveying device and an image forming apparatus according to the invention will be hereinafter described with reference to the drawings.

[Example Configuration of Image Forming Apparatus]

First, the image forming apparatus according to the invention will be described.

The image forming apparatus described below is to form images on a pinless continuous sheet which extends in one direction and does not have feed holes.

The one direction is typically the auxiliary scanning direction of image formation on a pinless continuous sheet. In this case, the image forming apparatus employs, as a recording medium on which images are to be formed, a pinless continuous sheet which extends continuously in the auxiliary scanning direction of image formation and the pinless continuous sheet is conveyed in its longitudinal direction, that is, in the direction in which it extends continuously, while it is held between rollers.

Figure 1:
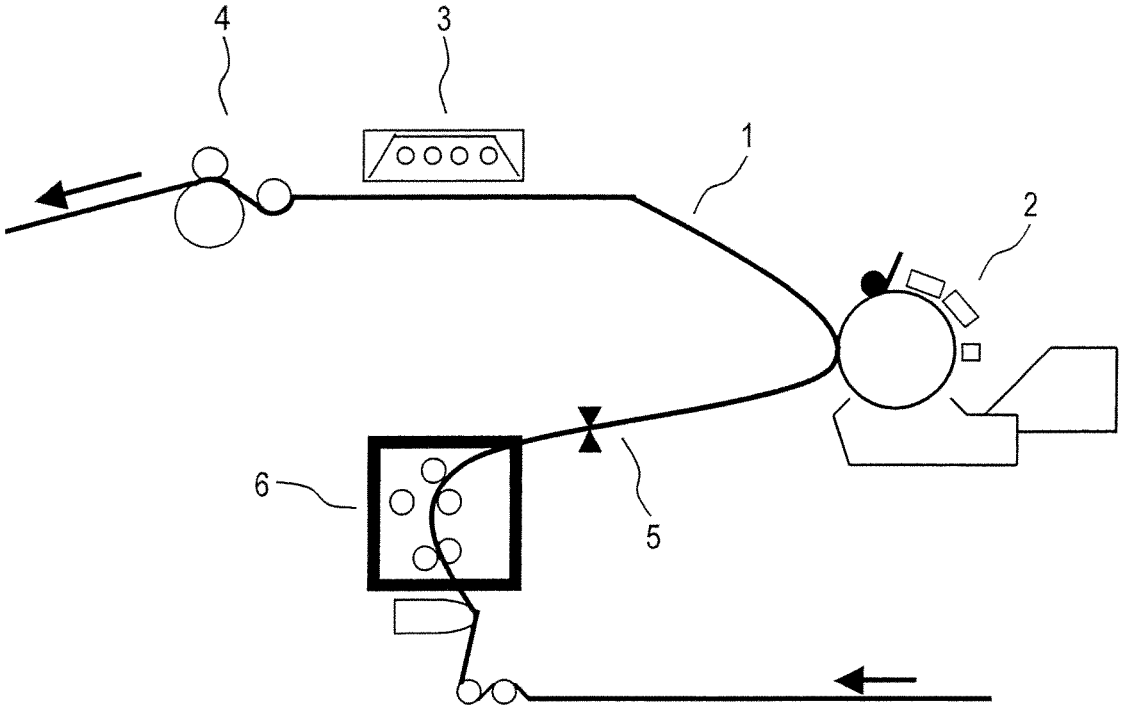
FIG. 1 illustrates a basic configuration of an image forming apparatus for forming images on a pinless continuous sheet.

FIG. 1 illustrates a basic configuration of the image forming apparatus for forming images on a pinless continuous sheet.

In the image forming apparatus of FIG. 1, an image forming unit 2 for forming an image on a pinless continuous sheet and a fuser 3 for fusing the image that has been formed on (transferred to) the pinless continuous sheet are disposed alongside a conveying path 1 along which the pinless continuous sheet is conveyed being oriented in such a manner that its longitudinal direction (the auxiliary scanning direction of image formation) coincides with the conveying direction.

The image forming unit 2 forms an image by executing charging, exposure, development, and transfer processes in this order utilizing an electrophotographic technology.

The image forming unit 2 and the fuser 3 will not be described in detail because they can be implemented by prior art technologies.

A drive roller unit 4 as a drive force applying unit is disposed on the conveying path 1 downstream of the fuser 3 in the sheet conveying direction. The drive roller unit 4 is composed of plural rollers and a drive source for driving them. These rollers convey a pinless continuous sheet while holding it from both sides or pressing it. Therefore, in what is called pinless conveying, the drive roller unit 4, which is disposed downstream of the image forming unit 2 and the fuser 3, manages the feed speed of the pinless continuous sheet.

Furthermore, a skew sensor 5 and a conveyance control unit 6 are disposed on the conveying path 1 upstream of the image forming unit 2.

The skew sensor 5 detects an edge position of a pinless continuous sheet to prevent a positional deviation in the width direction of the pinless continuous sheet (i.e., in the main scanning direction of image formation).

The conveyance control unit 6 controls conveyance of a pinless continuous sheet. To this end, the conveyance control unit 6 is configured in the following manner.

Figure 2:
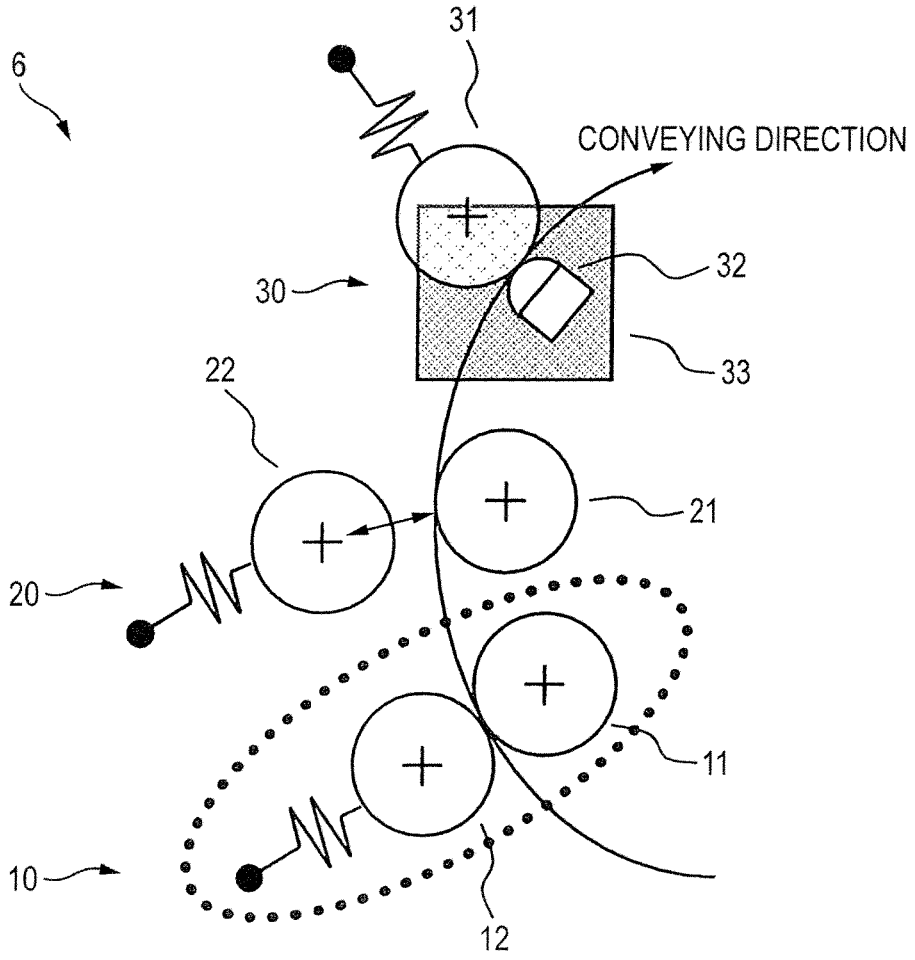
FIG. 2 illustrates an example configuration of a conveyance control unit of the image forming apparatus of FIG. 1.

FIG. 2 illustrates an example configuration of the conveyance control unit 6.

As shown in FIG. 2, the conveyance control unit 6 is equipped with a back tension mechanism 10, a back feed mechanism 20, and an aligning mechanism 30 which are arranged in this order downstream in the sheet conveying direction.

The back tension mechanism 10 is composed of a back tension drive roller 11 and a back tension pinch roller 12. The rollers 11 and 12 have a function of keeping a pinless continuous sheet tense in the auxiliary scanning direction by pinching it by holding it from both sides. In this manner, in the pinless conveying, a printing position is secures at the time of transfer by producing sheet tension by the back tension mechanism 10.

The back feed mechanism 20 is composed of a back feed drive roller 21 and a back feed pinch roller 22. The back feed pinch roller 22 can retreat from the conveying path 1 during printing. When a pinless continuous sheet is fed backward, the back feed pinch roller 22 is brought into pressure contact with the back feed drive roller 21 and the rollers 21 and 22 hold the pinless continuous sheet from both sides, whereby feeding force is applied to the pinless continuous sheet in the direction that is opposite to the sheet conveying direction.

The back tension mechanism 10 and the back feed mechanism 20 function as a reverse force applying unit for applying force to a pinless continuous sheet in the direction that is opposite to the sheet conveying direction.

The aligning mechanism 30 is composed of an inclined roller 31, a counter member 32, and a side guide 33.

The inclined roller 31 is disposed so as to form a certain angle (not equal to 0°) with the sheet conveying direction and is rotationally driven by a drive source (not shown). Therefore, the direction of feeding of a pinless continuous sheet by rotation of the inclined roller 31 is not parallel with the sheet conveying direction. That is, the inclined roller 31 is disposed so as to pay out a pinless continuous sheet in a direction (hereinafter referred to as "oblique direction") that forms a certain angle (not equal to 0°) with and hence is not parallel with the sheet conveying direction.

The counter member 32 is disposed at such a position as to be opposed to the inclined roller 31 with a pinless continuous sheet interposed in between. The counter member 32 and the inclined roller 31 hold a pinless continuous sheet from both sides and thereby realize a feed of the pinless continuous sheet in the oblique direction. For example, the counter member 32 is formed by molding a resin material. As described later, the surface of the counter member 32 on the side of the inclined roller 31 is a curved surface.

The side guide 33 is a plate-like member which extends in the sheet conveying direction and is disposed so that an edge of a pinless continuous sheet is brought into sliding contact with it.

The above-configured aligning mechanism 30 has a function of positioning a pinless continuous sheet in its width direction (i.e., the main scanning direction of image formation) in a process of its conveyance in such a manner that the inclined roller 31 exerts skew force on the pinless continuous sheet by feeding it in the oblique direction and thereby causes its edge to hit the side guide 33.

In the conveyance control unit 6 having the above configuration, the conveying path 1 of a pinless continuous sheet is curved so as to form an arc. This is to secure sufficient rigidity of a pinless continuous sheet being conveyed by curving it and to thereby prevent, for example, trouble that would otherwise occur when skew force is applied to the pinless continuous sheet. Another object is to realize efficient arrangement of the back tension mechanism 10, the back feed mechanism 20, the aligning mechanism 30, etc. in a limited space.

Since the conveying path 1 is curved in the conveyance control unit 6, in the aligning mechanism 30 which is part of the conveyance control unit 6 the surface of the counter member 32 on the side of the inclined roller 31 is made a curved surface.

[Example Configuration of Medium Conveying Device]

Next, the aligning mechanism 30 of the image forming apparatus will be described in more detail.

The aligning mechanism 30 is an important part or a constituent that characterizes the image forming apparatus as well as the medium conveying device according to the invention.

First Exemplary Embodiment

FIGS. 3A-3D illustrate an example configuration, according to a first embodiment, of the aligning mechanism 30.

Figure 3A:
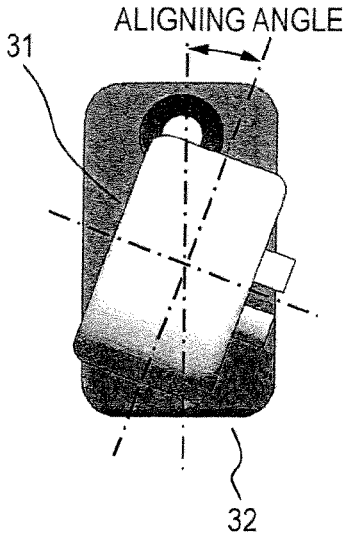
FIGS. 3A to 3D illustrate an example configuration, according to a first embodiment of the invention, of an aligning mechanism.

As already described above, the aligning mechanism 30 includes the inclined roller 31 and the counter member 32. To exert skew force on a pinless continuous sheet, as shown in FIG. 3A, the inclined roller 31 is disposed so as to form a certain angle (hereinafter referred to as "aligning angle") with the sheet conveying direction.

Figure 3B:
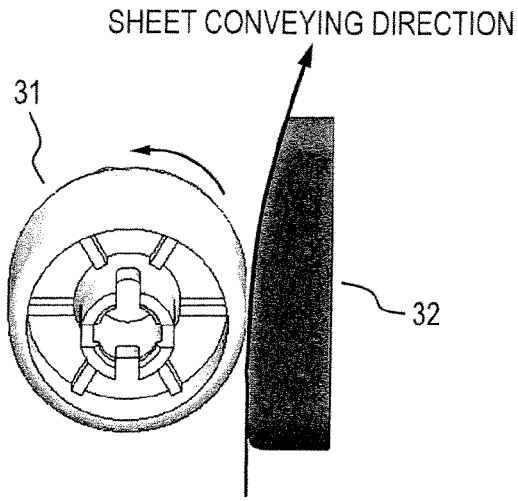

On the other hand, as shown in FIG. 3B, the surface of the counter member 32 on the side of the inclined roller 31 is made a curved surface.

Therefore, if, as in the conventional configuration, the outer circumferential surface of the inclined roller 31 were cylindrical and the rotation axis of the inclined roller 31 as oriented so as not to have the alignment angle were parallel with the surface (the line extending in the width direction of a pinless continuous sheet) of the counter member 32, the fact that the inclined roller 31 is disposed so as to have the aligning angle might cause a phenomenon that the inclined roller 31 and the counter member 32 are brought into point contact with each other in the initial state when pinching pressure is applied to the inclined roller 31 and local wear occurs with the point contact position as the origin.

Figure 3C:
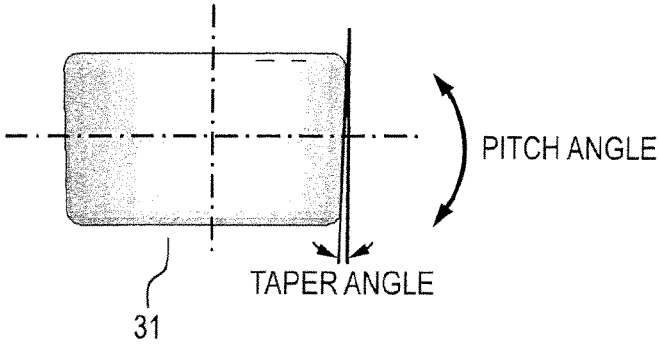

In view of the above, in the first embodiment, as shown in FIG. 3C, the aligning mechanism 30 is such that the outer circumferential surface of the inclined roller 31 is not parallel with its rotation axis but inclined from its rotation axis. That is, the inclined roller 31 is tapered so as to have a trapezoidal shape in cross section. This angle is hereinafter referred to as "taper angle."

Figure 3D:
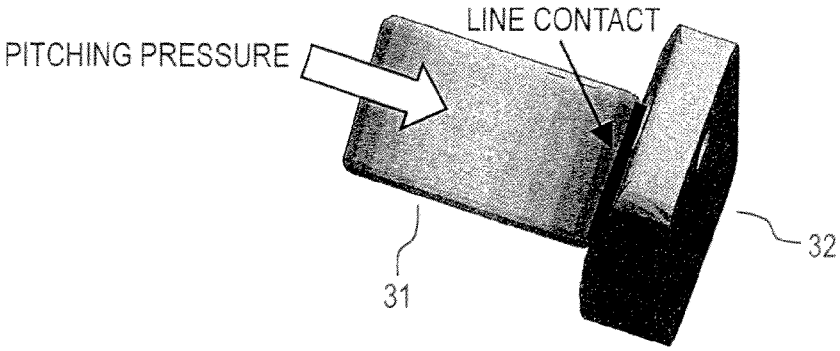

In the aligning mechanism 30, since the inclined roller 31 has the taper angle, even if the inclined roller 31 is disposed so as to have the aligning angle and the surface of the counter member 32 on the side of the inclined roller 31 is a curved surface, as shown in FIG. 3D, the outer circumferential surface of the inclined roller 31 conforms to the curved surface of the counter member 32 and the inclined roller 31 and the counter member 32 contact each other approximately in line contact.

As a result, the aligning mechanism 30 in which the outer circumferential surface of the inclined roller 31 has the taper angle is free of the problem of the conventional configuration that point contact occurs in the initial state and local wear occurs with the point contact position as the origin.

The taper angle of the outer circumferential surface of the inclined roller 31 is determined according to the aligning angle of the inclined roller 31 and the radius of curvature of the curved surface of the counter member 32.

Figure 4:
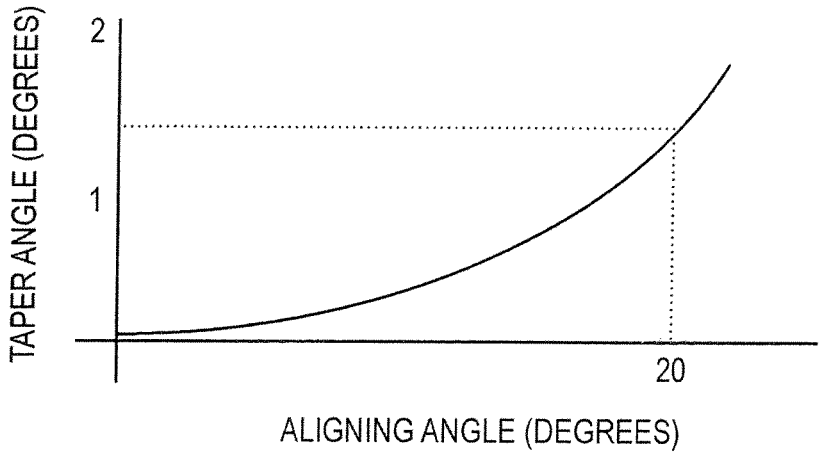
FIG. 4 is a graph showing a specific example of a relationship between the taper angle and the aligning angle.

FIG. 4 is a graph showing a specific example of a relationship between the taper angle and the aligning angle.

FIG. 4 shows an example relationship between the taper angle and the aligning angle in a case that the radius of curvature of the curved surface of the counter member 32 is set at a certain value. The relationship between the taper angle and the aligning angle depends on the radius of curvature.

For example, the relationship between the taper angle, the aligning angle, and the radius of curvature is determined uniquely by geometrical calculation processing or processing similar to it.

Therefore, once the aligning angle and the radius of curvature are determined from the apparatus specification, the sheet conveyance conditions, etc., the taper angle is determined uniquely on the basis of the aligning angle and the radius of curvature.

Incidentally, the portion that is given the taper angle, which is determined in the above-described manner, is not limited to the outer circumferential surface of the inclined roller 31.

Figure 5:
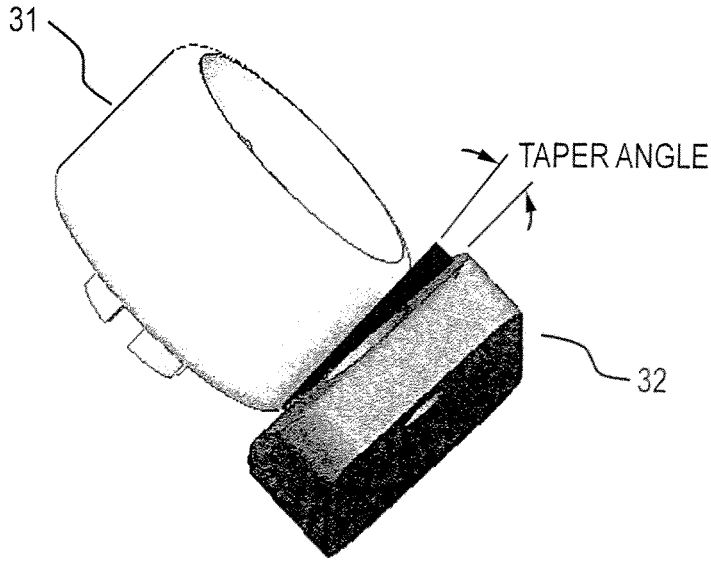
FIG. 5 illustrates another example configuration, according to the first embodiment of the invention, of the aligning mechanism.

FIG. 5 illustrates another example configuration, according to the first embodiment, of the aligning mechanism 30.

As shown in FIG. 5, the curved surface, opposed to the inclined roller 31, of the counter member 32 is given a taper angle. More specifically, the counter member 32 is tapered in such a manner that its cross section taken in the width direction of a pinless continuous sheet is inclined from one side to the other (lower on the side of the side guide 33 so as to be suitable for the aligning angle of the inclined roller 31). For such a counter member 23, the outer circumferential surface of the inclined roller 31 is made cylindrical.

Also in this configuration, the inclined roller 31 and the counter member 32 contact each other approximately in line contact.

As a further alternative, the rotation axis of the inclined roller 31 may be given a taper angle. That is, instead of giving the taper angle to the outer circumferential surface of the inclined roller 31, the rotation axis itself of the inclined roller 31 is inclined so that the rotation axis of the inclined roller 31 as oriented so as not to have the aligning angle is not parallel with the surface (the line extending in the width direction of a pinless continuous sheet) of the counter member 32. In this case, the outer circumferential surface of the inclined roller 31 is cylindrical and the curved surface of the counter member 32 is not given a taper angle.

Also in the case where the rotation axis of the inclined roller 31 is given the taper angle, the inclined roller 31 and the counter member 32 contact each other approximately in line contact.

As described above, the taper angle which depends on the aligning angle of the inclined roller 31 and the radius of curvature of the curved surface of the counter member 32 may be given to any of the outer circumferential surface of the inclined roller 31, the rotation axis of the inclined roller 31, and the surface, opposed to the inclined roller 31, of the counter member 32.

Second Exemplary Embodiment

Figure 6A:
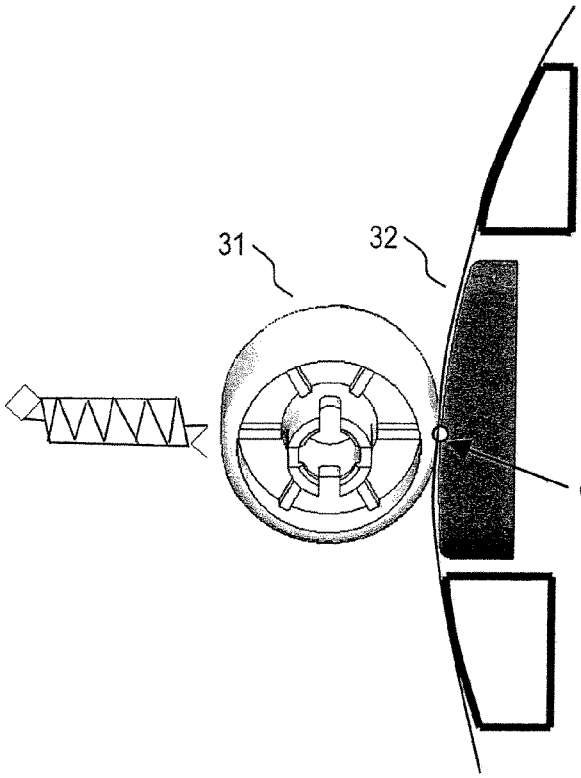
FIGS. 6A and 6B illustrate an example configuration, according to a second embodiment of the invention, of the aligning mechanism.
Figure 6B:
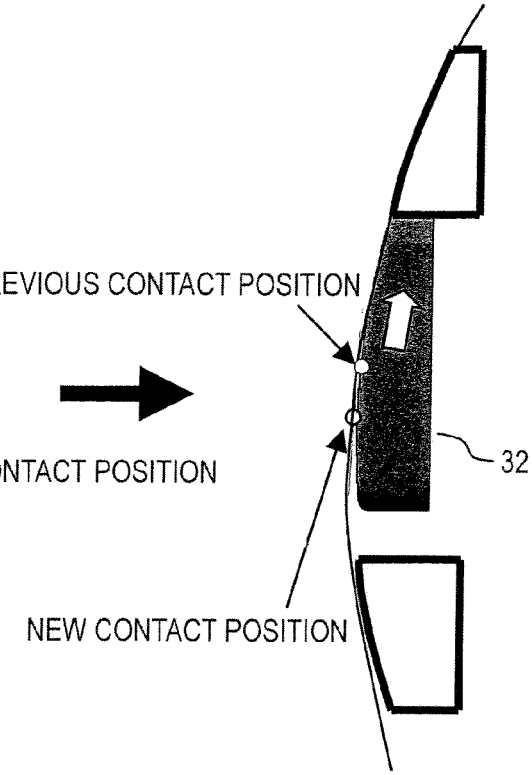

FIGS. 6A and 6B illustrate an example configuration, according to a second embodiment, of the aligning mechanism 30.

In an aligning mechanism having a general configuration, whereas an inclined roller is driven rotationally, a counter member which is opposed to the inclined roller is fixed. Therefore, whereas the inclined roller wears being rotated, a particular portion of the counter member wears. As a result, the counter member needs to be replaced earlier than the inclined roller.

However, the inclined roller and the counter member are disposed close to each other, they should be replaced simultaneously in view of the work efficiency of a maintenance person and other factors.

In view of the above, according to the second embodiment, as shown in FIGS. 6A and 6B, the aligning mechanism 30 is configured in such a manner that the counter member 32 can be moved with respect to the inclined roller 31 in the sheet conveying direction.

A typical method for moving the counter member 32 is to use a slide mechanism including a rail member. However, the counter member 32 may be moved by using a mechanism that utilizes another known technique.

A further method for moving the counter member 32 is to use a drive source such as an electromagnetic solenoid or the like. Instead of moving the counter member 32 automatically by the drive source, it may be moved manually.

Typical timing for moving the counter member 32 is every time a preset condition is satisfied. For example, the preset condition is that the number of times of image formation, the sheet conveyance distance, or the like has reached a set number or value.

As described above, in the second embodiment, the aligning mechanism 30 is such that the counter member 32 is supported in a movable manner. That is, a relative position varying unit for varying the position of the counter member 32 with respect to the inclined roller 31 is provided at the location where the counter member 32 is supported.

Where the relative positional relationship between the inclined roller 31 and the counter member 32 is varied, the position on the curved surface of the counter member 32 where the inclined roller 31 is in contact with the counter member 32 is varied. Therefore, if the relative positional relationship between the inclined roller 31 and the counter member 32 is varied every time the preset condition is satisfied, the inclined roller 31 is brought into contact with the single counter member 32 at plural positions, as a result of which the cycle of replacement of the counter member 32 due to its wear is increased.

Therefore, in the configuration in which the relative positional relationship between the inclined roller 31 and the counter member 32 is varied, since the cycle of replacement of the counter member 32 due to its wear is increased, it becomes possible to replace the inclined roller 31 and the counter member 32 simultaneously.

Incidentally, the manner of variation of the relative positional relationship between the inclined roller 31 and the counter member 32 is not limited to moving the counter member 32 in the sheet conveying direction.

Figure 7:
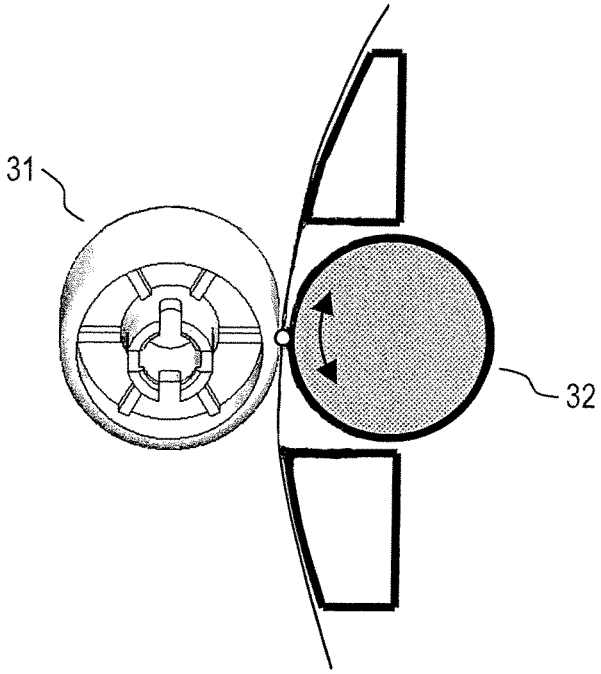
FIG. 7 illustrates another example configuration, according to the second embodiment of the invention, of the aligning mechanism.

FIG. 7 shows another example configuration, according to the second embodiment, of the aligning mechanism 30.

As shown in FIG. 7, the counter member 32 has a cylindrical shape and is rotated. The position on the counter member 32 where the inclined roller 31 is in contact with the counter member 32 is varied by rotating the counter member 32.

Also in this configuration, the relative positional relationship between the inclined roller 31 and the counter member 32 is varied, which allows them to be replaced simultaneously.

As a further alternative, the relative positional relationship between the inclined roller 31 and the counter member 32 may be varied by moving the inclined roller 31.

Third Exemplary Embodiment

Figure 8:
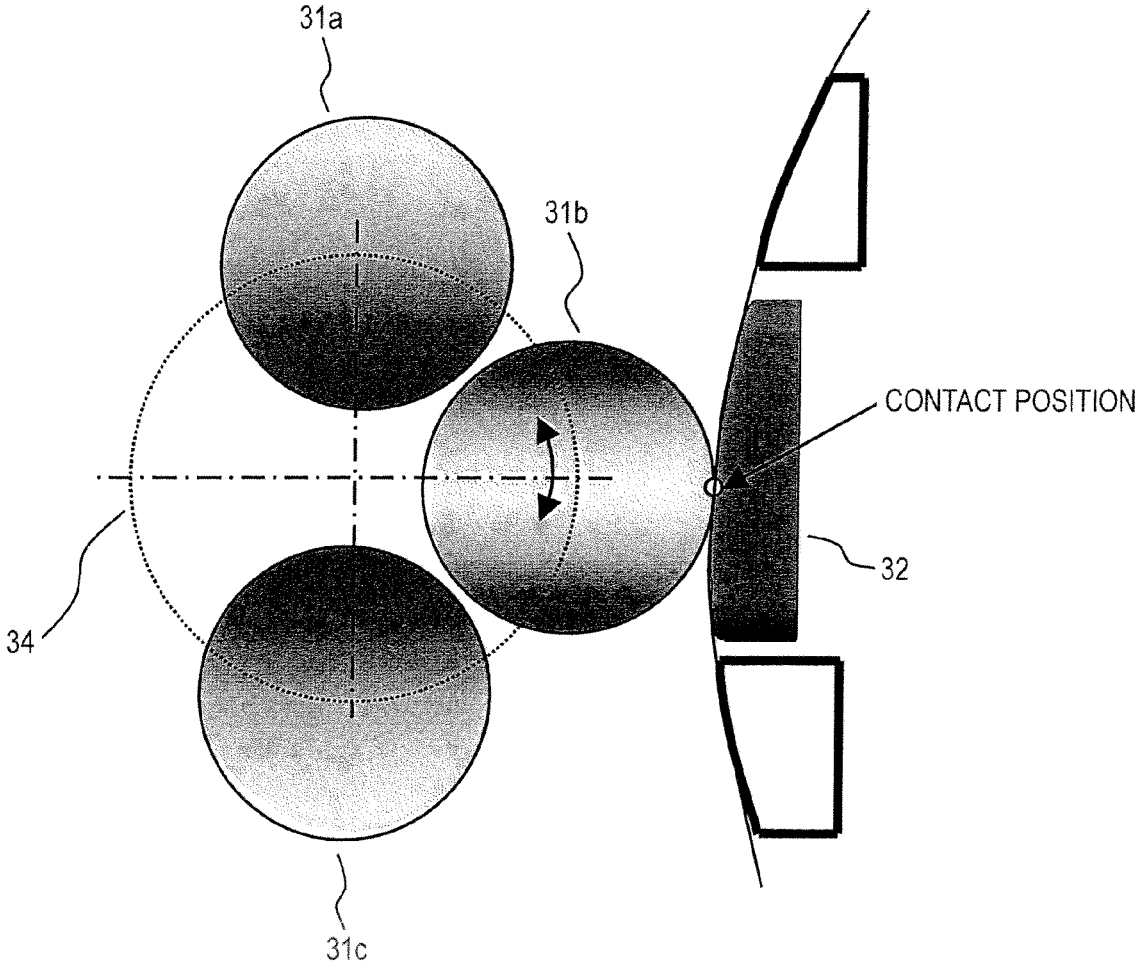
FIG. 8 illustrates an example configuration, according to a third embodiment of the invention, of the aligning mechanism.

FIG. 8 illustrates an example configuration, according to a third embodiment, of the aligning mechanism 30.

As shown in FIG. 8, in the third embodiment, the aligning mechanism 30 is such that plural inclined rollers 31 are mounted on a switching mechanism 34. The switching mechanism 34 switches the inclined roller 31 to be opposed to the counter member 32 among the plural inclined rollers 31.

The configuration of the switching mechanism 34 is not limited to a particular one. The switching mechanism 34 may be realized by utilizing a known technique as exemplified by a combination of a rotary mechanism and its drive source.

The plural inclined rollers 31 among which switching is made by the switching mechanism 34 should correspond to different sets of sheet conveyance conditions. That is, the plural inclined rollers 31 are given different sets of pinching pressure, friction force, an aligning angle, a taper angle, etc. For example, as shown in FIG. 8, the switching mechanism 34 correspond to different sets of sheet conveyance conditions may be a thick sheet inclined roller 31*a* to which high pinching pressure is exerted, a thin sheet inclined roller 31*b* to which low pinching pressure is exerted, and a back feed inclined roller 31*c* to which back feed pinching pressure is exerted. However, naturally, the plural inclined rollers 31 are not limited to them.

In the above-configured aligning mechanism 30, when sheet conveyance conditions of a pinless continuous sheet to pass through the aligning mechanism 3 are determined on the basis of the details of a mode setting made through an operating panel of the image forming apparatus, a result of a sheet kind detection done at the time of mounting of a pinless continuous sheet, or like information, the switching mechanism 34 moves an inclined roller 31 corresponding to the determined sheet conveyance conditions to the position that is opposed to the counter member 32. That is, an inclined roller 31 corresponding to the determined sheet conveyance conditions is selected and placed at the position that is opposed to the counter member 32.

As described above, in the third embodiment, the aligning mechanism 30 is such that switching is made according to sheet conveyance conditions among the plural inclined rollers 31 that are given different sets of pinching pressure, friction force, an aligning angle, a taper angle, etc.

Where the single inclined roller 31 is used, it is difficult to realize sheet conveyance that is suitable for each set of sheet conveyance conditions while accommodating various sets of sheet conveyance conditions. In contrast, in the third embodiment, the aligning mechanism 30 enables conveyance of a pinless continuous sheet using an inclined roller 31 that is suitable for each set of sheet conveyance conditions by switching among the plural inclined rollers 31.

Since the plural inclined rollers 31 are prepared and an inclined roller 31 to be used is selected from them, it is possible to handle a special sheet or the like by adding an inclined roller 31 that is specialized for it. The extendibility, versatility, etc. of the medium conveying device in terms of sheet kinds it can accommodate can thus be made higher than in a case that this configuration is not employed.

Although the preferred embodiments of the invention have been described above, the invention is not limited to them.

That is, the invention is not limited to the above exemplary embodiments and can be modified without departing from the spirit and scope of the invention.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention defined by the following claims and their equivalents.

What is claimed is:

1. A medium conveying device comprising:

an inclined roller that has a rotation axis, in which the rotation axis is inclined with respect to a conveying direction of the recording medium so that the inclined roller feeds the recording medium in a direction that is inclined from the conveying direction of the recording medium; and a counter member disposed at such a position as to be opposed to the inclined roller with the recording medium interposed in between, the counter member being a pad having a curved surface on a side of the inclined roller, the inclined roller rotating to feed the recording medium interposed between the inclined roller and the counter member, wherein the counter member does not rotate, and wherein:

an outer circumferential surface of the inclined roller is formed at a predetermined angle inclined from the rotation axis of the inclined roller so that a distance between the rotation axis and the outer circumferential surface is not constant along a direction of the rotation axis such that the outer circumferential surface abuts the curved surface, via the recording medium, substantially along a line.

2. The image forming apparatus according to claim 1, wherein the recording medium is a continuous sheet which extends continuously in one direction.

3. The image forming apparatus according to claim 1, which further comprising a relative position varying unit that varies a relative positional relationship between the inclined roller and the counter member in a state that the inclined roller and the counter member are opposed to each other.

4. The image forming apparatus according to claim 1, wherein:

the image forming apparatus comprises a plurality of inclined rollers; and the image forming apparatus further comprises a switching mechanism that switches the inclined roller to be opposed to the counter member among the plurality of inclined rollers.

5. The image forming apparatus according to claim 1, wherein a relative position of the counter member to the inclined roller is varied so that a position on the curved surface of the counter member at which the inclined roller is abuts the counter member, via the recording medium, is varied.

6. A medium conveying device which conveys a recording medium in a conveying direction comprising:

a counter member disposed in a conveying path along which the recording medium is conveyed, the counter member comprising a curved surface along which the recording medium is conveyed, the counter member being a pad that does not rotate; and an inclined roller disposed opposite the counter member in the conveying path, the inclined roller comprising an outer circumferential surface opposing the curved surface of the counter member, and a rotational axis of the inclined roller being inclined with respect to the conveying direction such that the inclined roller conveys the recording medium interposed between the inclined roller and the counter member in an oblique direction that is inclined from the conveying direction, wherein one of the outer circumferential surface of the inclined roller, a rotation axis of the inclined roller, and the curved surface of the counter member is arranged at a predetermined angle based on a function of (i) an angle between the oblique direction and the medium conveying direction and (ii) a radius of curvature of the curved surface such that the outer circumferential surface abuts the curved surface, via the recording medium, substantially along a line.

7. The medium conveying device according to claim 6, wherein a relative position of the counter member to the inclined roller is varied so that a position on the curved surface of the counter member at which the inclined roller is abuts the counter member, via the recording medium, is varied.

* * * * *